US007096627B2

(12) United States Patent
Wade

(10) Patent No.: US 7,096,627 B2
(45) Date of Patent: Aug. 29, 2006

(54) RAIN HEAD

(76) Inventor: Rodney George Wade, 148 Wongawallen Drive, Upper Coomera, Queensland (AU) 4210

( * ) Notice: Subject to any disclaimer, the term of this patent is extended or adjusted under 35 U.S.C. 154(b) by 43 days.

(21) Appl. No.: 10/691,594

(22) Filed: Oct. 24, 2003

(65) Prior Publication Data

US 2005/0086883 A1 Apr. 28, 2005

(51) Int. Cl.
*E04D 13/04* (2006.01)

(52) U.S. Cl. ..... 52/12; 52/16; 52/302.1; 404/2; 210/155; 210/162; 210/335; 137/357

(58) Field of Classification Search ..... 52/94–96, 52/11–16, 24–26, 90.1, 90.2; 210/155, 162, 210/335
See application file for complete search history.

(56) References Cited

U.S. PATENT DOCUMENTS 971,578 A * 10/1910 Walker ..... 210/421
4,112,691 A * 9/1978 Ebeling et al. ..... 405/119
4,492,491 A * 1/1985 Lunden et al. ..... 405/119
4,949,514 A * 8/1990 Weller ..... 52/12
5,037,541 A * 8/1991 Ruey-Jang et al. ..... 210/141
5,103,601 A * 4/1992 Hunt ..... 52/12
5,114,594 A * 5/1992 Rosebrock et al. ..... 210/767
5,297,367 A * 3/1994 Sainz ..... 52/12
5,409,602 A * 4/1995 Sorenson ..... 210/162
5,526,612 A * 6/1996 Wade ..... 52/12
5,788,849 A * 8/1998 Hutter, Jr. et al. ..... 210/163
5,873,999 A * 2/1999 Gaiser ..... 210/488
6,134,843 A * 10/2000 Tregear ..... 52/12
6,269,953 B1 * 8/2001 Seyffert et al. ..... 209/399
6,537,446 B1 * 3/2003 Sanguinetti ..... 210/163
6,584,733 B1 * 7/2003 Wade ..... 52/14
6,766,636 B1 * 7/2004 Shingu et al. ..... 60/39.092

* cited by examiner

*Primary Examiner*—Robert Canfield
(74) *Attorney, Agent, or Firm*—Millen, White, Zelano & Branigan, P.C.

(57) ABSTRACT

A rain head is disclosed having three filters through which water entering an inlet to the rain head must pass before passing out through an outlet from the rain head. The filters remove successively smaller particles from the water.

20 Claims, 2 Drawing Sheets

RAIN HEAD

BACKGROUND OF THE INVENTION

This invention relates to a rain head. Rain heads are located adjacent the underside of a roof gutter and are attached to an upper end of a downpipe. Rain heads are designed to provide a "safety break" between the downpipe and the roof gutter. This safety break ensures that in the event of a downpipe blockage or rain head blockage from the gutter, water can escape and spill onto the ground and thus prevent flooding of the eaves, wall cavity and the building.

When water from a roof of a building is captured for use and storage in a holding tank the quality of water is reduced by coliforms from animal matter and by turbidity.

Coliforms are the result of animal matter entering the tank whilst turbidity is a result of suspended solids like fine dust particles and vegetable matter.

In an attempt at reducing the presence of coliforms and reducing turbidity, known rain heads usually incorporate a single filter to exclude particles down to a size of about 955 microns. This is usually achieved by stainless steel mesh.

Screening in known rain heads is not particularly effective and these rain heads readily become blocked if not cleaned at relatively short intervals. Once a rain head becomes blocked, water which would otherwise be collected in the holding tank is lost.

OBJECT OF THE INVENTION

It is an object of the present invention to provide a rainhead which at least minimises the disadvantages mentioned above.

SUMMARY OF THE INVENTION

According to one aspect the invention provides a rainhead having an inlet and an outlet, a primary filter through which water from the inlet may flow, a secondary filter through which water passing through the primary filter may flow and a tertiary filter located between the secondary filter and the outlet, the secondary filter filters smaller particles from the water than the primary filter and the tertiary filter filters smaller particles from the water than the secondary filter.

The primary filter is preferably a filter screen and may consist a stainless steel screen. The screen may consist of woven stainless steel. Preferably, the primary filter has apertures in the screen of between 4 to 6 mm.

The secondary filter is preferably a filter screen and may consist a stainless steel screen. The screen may consists of woven stainless steel. Preferably the secondary filter has apertures of 1 to 1.5 mm.

The tertiary filter preferably is constructed of a material that does not allow the direct flow of water through it from one side to the other. In one embodiment, the tertiary filter consists of one or more layers of geotextile fabric. Preferably a non-woven geotextile material is employed. In one embodiment the geotextile consists of non-woven polyester having a thickness of between 4.8 to 5.7 mm per layer, a drop cone characteristic of between $H_{50}$ 6400 to $H_{20}$ 12600 per layer, a CBR burst strength of between 5100 N@60% to 9600 N@60% per layer, a tensile strength of between 33 kN/m×D/18 kN/m MD to 68 kN/m×D/38 kN/m MD per layer, a pore size between 100 mm to 90 m per layer and a flow rate of between 80 $Lm^2/_s$ to 65 $Lm^2/_s$ per layer.

Preferably the tertiary filter separates particles down to 50 micron from the water that passes through it.

The filters may extend in a planar fashion across the rain head. Preferably, at least the primary and secondary filters may be raked and arranged so that they have a central peaked zone and extend from that zone at an inclined angle. In this way, particles trapped by these filters may wash to the sides away from the central peaked zone to thereby increase the efficiency of the rain head and extend the time between maintenance of the rain head.

Preferably the rain head has a stepped peripheral wall and the filters may rest upon inwardly directed steps of the inside of the wall.

The rain head has a downpipe connecting portion extending therefrom which provides the outlet from the rain head. The connecting portion may consist of a spigot. Preferably, the connecting portion consists of two spigots and the spigots may be concentrically aligned relative to one another.

A downpipe may be received in the space between the two spigots with either the outer face of the downpipe abutting the inside of the outer spigot or the inside of the downpipe abutting the outer face of the inside spigot. Alternatively, the inside of a downpipe may abut the outer face of the outside spigot.

DETAILED DESCRIPTION OF PREFERRED EMBODIMENTS OF THE INVENTION

Figure 1:
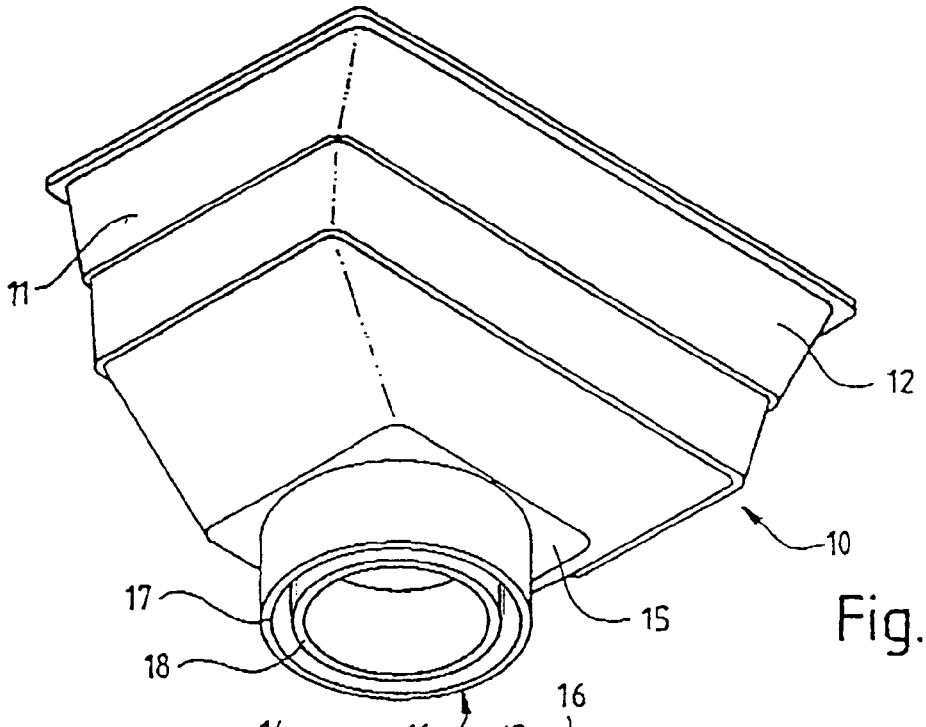
FIG. 1 shows a bottom perspective view of a known rain head.
Figure 2:
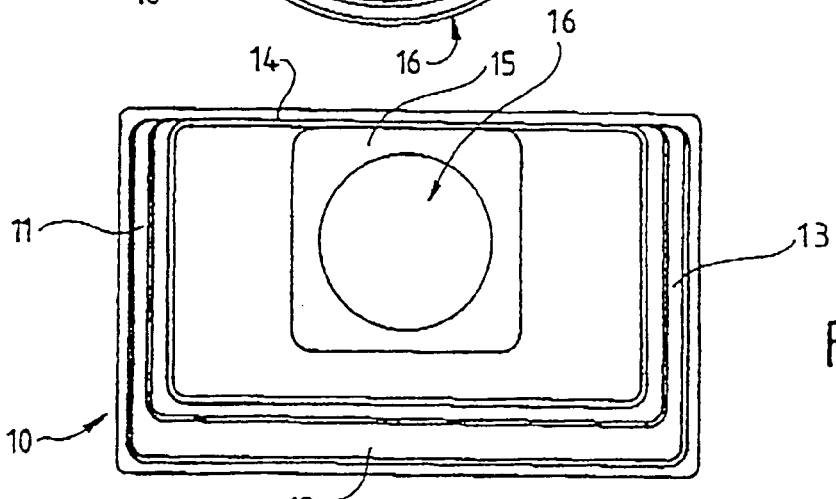
FIG. 2 shows a plan view of the rain head of FIG. 1.
Figure 3:
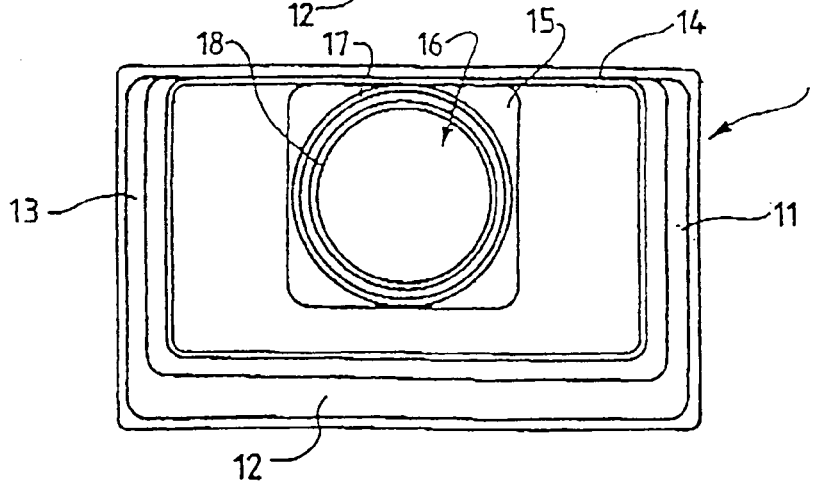
FIG. 3 shows an inverted plan view of the rain head of FIG. 1.

FIGS. 1 to 3 show a known rain head 10 having a substantially rectangular body with downwardly sploping walls 11, 12, 13 on three sides and a substantially perpendicular rear wall 14.

The base 15 of the rain head 10 is substantially horizontal and includes an outlet 16 formed centrally therewith. The outlet 16 is defined by two spigots 17, 18 each having a common central axis with the other. The spigots 17, 18 have a circular configuration for attachment to a downpipe by press fitting either with or without the use of an adhesive.

Figure 4:
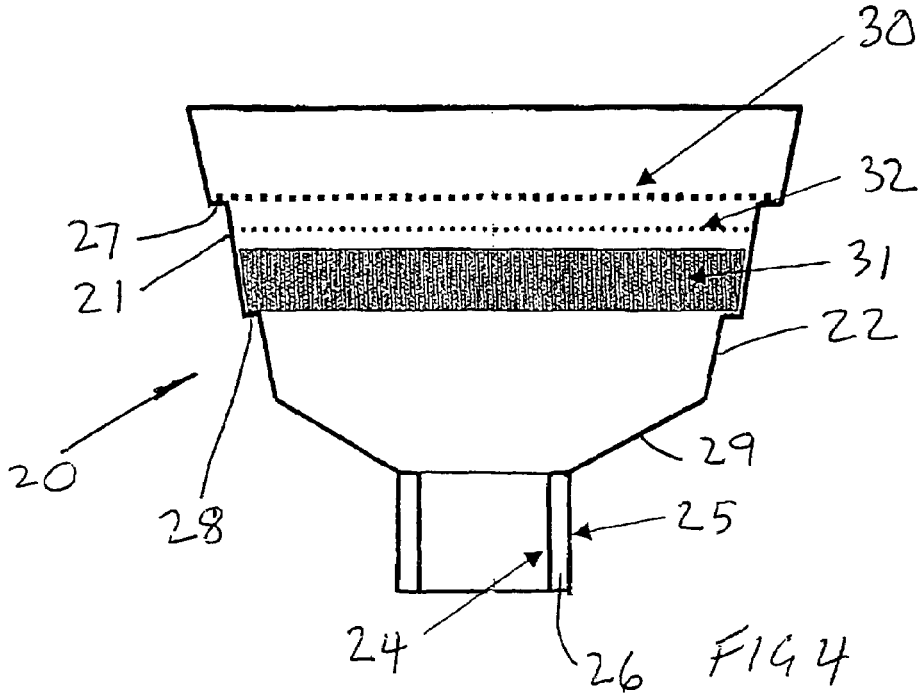
FIG. 4 is a transverse sectional view of a rain head according to one embodiment of the invention; and, FIG. 5 is a transverse sectional view of a rain head according to another embodiment of the invention.

FIG. 4 shows a vertical sectional view through a rain head 20 according to one embodiment of the invention. The rain head 20 has downwardly sloping sides 21, 22. Three of the sides may slope downwardly as shown and the rear side may be substantially perpendicular like the prior rain head of FIGS. 1 to 3. The rain head 20 has an open top or inlet and an outlet 23 defined by spigots 24, 25. The spigots 24, 25 have a common central axis and are concentrically arranged relative to one another and define a space 26 between them.

The sides 21, 22 are stepped at 27 and 28. A lower part of the rain head 20 has a downwardly sloping wall 29 from which the spigots 24, 25 extend.

In FIG. 4 a primary filter 30 rests upon step 27. A tertiary filter 31 rests upon step 28. A secondary filter 32 is located between the primary and tertiary filters and is spaced from them and extends between sides 21, 22.

Water may enter through the open top of the rain head and progressively passes through filters 30, 32 and 31 and progressively smaller particles are separated from the water before it exits through outlet 23. By having three filters arranged in this way it is possible to have longer intervals at which the filters are removed and cleaned. Likewise, unlike with a single screen where relatively small particles may pass and the single screen may clog quickly the provision of multiple screens of progressively smaller aperture size, the danger of clogging is lessened and relatively small particles may still be separated from the water by the tertiary filter.

Figure 5:
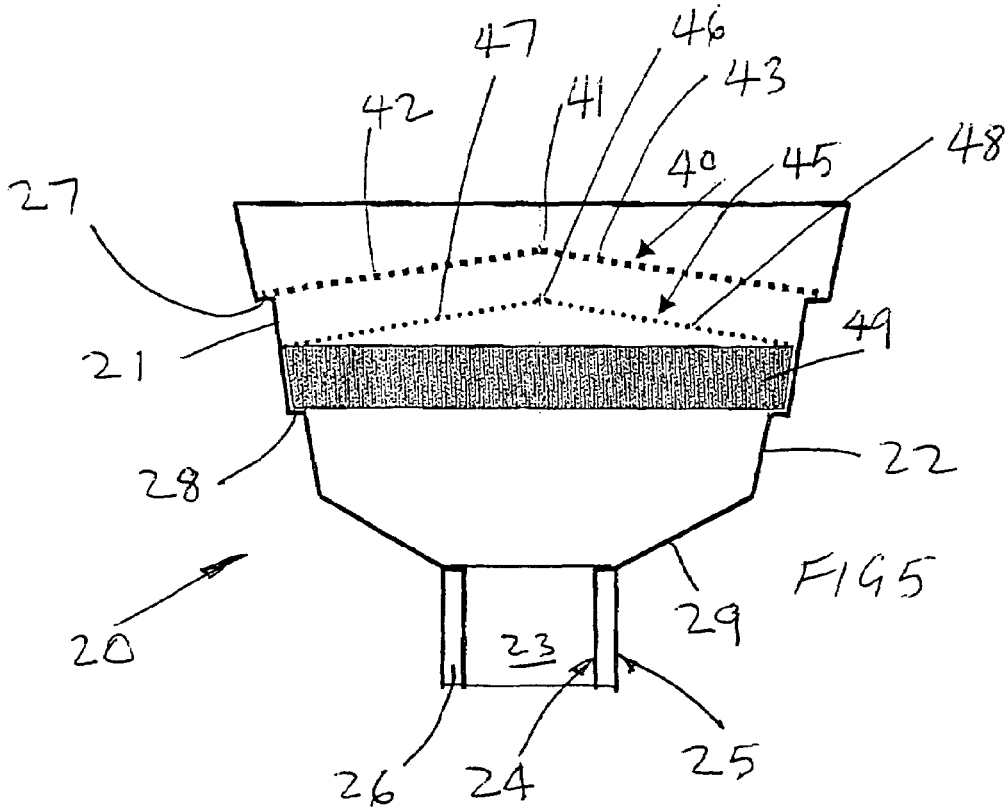

FIG. 5 shows a transverse sectional view of a rain head 20 like that shown in FIG. 4 and like numerals are used to denote like parts. In this embodiment the primary filter 40 is raked and has a peaked portion 41 and downwardly inclined portions 42, 43. Large particles caught by filter 40 may be washed to the sides to minimise restriction of water flow through the filter 40. Likewise, secondary filter 45 may also be raked and has a peaked portion 46 with downwardly inclined portions 47, 48. A tertiary filter 49 is also present.

By having three filters of this type the larger debris or particles is progressively filtered from the water and the tendancy for blocking is lessened. Longer intervals between cleaning of the filters is possible than was the case with prior rain heads and more effective filtering of the water is achieved.

I claim:

1. A rain head having an inlet and an outlet, at least a primary filter through which water may pass and a secondary filter through which water passing through the primary filter may flow, the secondary filter filtering smaller particles from the water than the primary filter, the rain head having a downpipe connecting portion extending therefrom and a free end of the connecting portion providing the inlet from the rain head, wherein at least one of the primary filter and the secondary filter has a peaked portion spaced from sides of the filter and downwardly sloping portions extending from the peak to the sides, whereby particles caught by the filters may be washed to the sides of the filter to minimize restriction of water flow through the filters.

2. The rain head of claim 1 wherein the primary filter is a filter screen.

3. The rain head of claim 2 wherein the screen consists of woven stainless steel.

4. The rain head of claim 3 wherein the screen has an aperture size of 4 to 6 mm.

5. The rain head of claim 2 wherein the screen has an aperture size of 4 to 6 mm.

6. The rain head of claim 1 wherein the secondary filter is a filter screen.

7. The rain head of claim 6 wherein the screen has an aperture size of 1 to 1.5 m.

8. The rain head of claim 6 wherein the screen consists of woven stainless steel.

9. The rain head of claim 8 wherein the screen has an aperture size of 1 to 1.5 m.

10. The rain head of claim 1 including a tertiary filter located between the secondary filter an the outlet, the tertiary filter filtering smaller particles from the water than the secondary filter.

11. The rain head of claim 10 wherein the tertiary filter consists of one or more layers of geotextile fabric.

12. The rain head of claim 11 wherein the tertiary filter has a drop cone characteristic of between $H_{50}$ 6400 to $H_{20}$ 12600 per layer, a CBR burst strength of between 5100 N@60% to 9600 N@60% per layer, a tensile strength of between 33 kN/m×D/18 kN/m MD to 68 kN/m D/38 kN/m MD per layer, a pore size between 100 mm to 90 mm per layer and a flow rate of between 80 $Lm^2/_s$ to 65 $Lm^2/_s$ per layer.

13. The rain head of claim 11 wherein the geotextile fabric is non-woven.

14. The rain head of claim 13 wherein the fabric has a thickness between 4.8 to 5.7 mm.

15. The rain head of claim 14 wherein the tertiary filter has a drop cone characteristic of between $H_{50}$ 6400 to $H_{20}$ 12600 per layer, a CBR burst strength of between 5100 N@60% to 9600 N@60% per layer, a tensile strength of between 33 kN/m×D/18 kN/m MD to 68 kN/m D/38 kN/m MD per layer, a pore size between 100 mm to 90 mm per layer and a flow rate of between 80 $Lm^2/_s$ to 65 $Lm^2/_s$ per layer.

16. The rain head of claim 13 wherein the tertiary filter has a drop cone characteristic of between $H_{50}$ 6400 to $H_{20}$ 12600 per layer, a CBR burst strength of between 5100 N@60% to 9600 N@60% per layer, a tensile strength of between 33 kN/m×D/18 kN/m MD to 68 kN/m D/38 kN/m MD per layer, a pore size between 100 mm to 90 mm per layer and a flow rate of between 80 $Lm^2/_s$ to 65 $Lm^2/_s$ per layer.

17. The rain head of claim 10 wherein the tertiary filter separates particles down to 50 micron from the water that passes through it.

18. The rain head of claim 1 wherein both the primary and secondary filters have peaked portions spaced from sides of the filter and downwardly sloping portions extending from the peaks to the sides.

19. The rain head of claim 1 having a stepped periphery.

20. The rain head of claim 1 having a downpipe connecting portion extending therefrom and a free end of the connecting portion providing the inlet from the rain head.

* * * * *